US009732753B2

(12) United States Patent
Hirata et al.

(10) Patent No.: US 9,732,753 B2
(45) Date of Patent: Aug. 15, 2017

(54) SCROLL COMPRESSOR WITH INCLINED SURFACES ON THE STEPPED PORTIONS

(71) Applicant: MITSUBISHI HEAVY INDUSTRIES AUTOMOTIVE THERMAL SYSTEMS CO., LTD., Kiyosu-shi, Aichi (JP)

(72) Inventors: Hirofumi Hirata, Tokyo (JP); Takayuki Kuwahara, Tokyo (JP); Hiroshi Yamazaki, Tokyo (JP)

(73) Assignee: MITSUBISHI HEAVY INDUSTRIES AUTOMOTIVE THERMAL SYSTEMS CO., LTD., Kiyosu-shi (JP)

( * ) Notice: Subject to any disclaimer, the term of this patent is extended or adjusted under 35 U.S.C. 154(b) by 379 days.

(21) Appl. No.: 14/365,805

(22) PCT Filed: Dec. 6, 2012

(86) PCT No.: PCT/JP2012/081711
§ 371 (c)(1),
(2) Date: Jun. 16, 2014

(87) PCT Pub. No.: WO2013/105368
PCT Pub. Date: Jul. 18, 2013

(65) Prior Publication Data

US 2014/0308146 A1 Oct. 16, 2014

(30) Foreign Application Priority Data

Jan. 13, 2012 (JP) ..... 2012-005410

(51) Int. Cl.
*F04C 18/02* (2006.01)
*F04C 27/00* (2006.01)

(52) U.S. Cl.
CPC ..... *F04C 18/0246* (2013.01); *F04C 18/0215* (2013.01); *F04C 18/0276* (2013.01);
(Continued)

(58) Field of Classification Search
CPC ..... F04C 18/0246; F04C 18/0276; F04C 18/0284; F04C 18/0215; F04C 2270/13
See application file for complete search history.

(56) References Cited

U.S. PATENT DOCUMENTS 5,630,684 A * 5/1997 Yamaguchi ..... F04C 18/0284 29/888.022
5,807,088 A * 9/1998 Fukanuma ..... F04C 18/0284 418/55.2

(Continued)

FOREIGN PATENT DOCUMENTS

CN 1769708 A 5/2006
CN 101063449 A 10/2007

(Continued)

OTHER PUBLICATIONS

Decision to Grant a Patent dated Nov. 4, 2015, issued in counterpart Japanese Patent Application No. 2012-005410 (3 pages), Explanation of relevence—"The Decision to Grant a Patent has been received."

(Continued)

*Primary Examiner* — Mary A Davis
(74) *Attorney, Agent, or Firm* — Westerman, Hattori, Daniels & Adrian, LLP

(57) ABSTRACT

In a stepped scroll compressor, inclined surfaces (28, 29) of which heights are gradually reduced toward stepped portions are formed in a range W of at least 2ρ to 3ρ (here, ρ denotes a turning radius of a turning scroll) at (1) any one or both of inner peripheral end portions of high top lands (14H, 15H) of both scrolls and inner peripheral end portions of low bottom lands (14J, 15J) of the opposite scrolls corresponding to the inner peripheral end portions and (2) any one or both of outer peripheral end portions of high bottom lands (14K, 15K) of both the scrolls and outer peripheral end portions of low top lands (14I, 15I) of the opposite scrolls (Continued)

corresponding to the outer peripheral end portions, on the stepped portions (14F, 15F and 14G, 15G) of the top and bottom lands.

7 Claims, 4 Drawing Sheets

(52) U.S. Cl.
CPC ..... *F04C 18/0284* (2013.01); *F04C 27/005* (2013.01); *F04C 2270/13* (2013.01)

(56) References Cited

U.S. PATENT DOCUMENTS

| | | | | |
|---|---|---|---|---|
| 8,092,199 | B2 * | 1/2012 | Mizuno | F04C 18/0215 418/150 |
| 2002/0051719 | A1 | 5/2002 | Shiibayashi et al. | |

FOREIGN PATENT DOCUMENTS

| | | | |
|---|---|---|---|
| EP | 1 262 665 | A1 | 12/2002 |
| JP | 61-62292 | U | 4/1986 |
| JP | 5-187371 | A | 7/1993 |
| JP | 2002-5052 | A | 1/2002 |
| JP | 2002-54585 | A | 2/2002 |
| JP | 2002-213372 | A | 7/2002 |
| JP | 2002-364560 | A | 12/2002 |
| JP | 2006-241977 | A | 9/2006 |
| JP | 2009-68412 | A | 4/2009 |
| JP | 4545039 | B2 | 9/2010 |
| JP | 4690743 | B2 | 6/2011 |

OTHER PUBLICATIONS

Extended European Search Report dated Aug. 20, 2015 issued in counterpart European Application No. 12864772.4 (6 pages).

Office Action dated Sep. 6, 2015, issued in counterpart Chinese Application No. 201280064670.9, with English translation (12 pages).

International Search Report dated Mar. 12, 2013, issued in corresponding application No. PCT/JP2012/081711.

Written Opinion of the International Searching Authority issued on Mar. 12, 2013, in corresponding application No. PCT/JP2012/071711.

Notification on the Grant of Patent Right for Invention dated Dec. 1, 2016, issued in counterpart Chinese Patent Application No. 201280064670.9, with English translation. (4 pages).

* cited by examiner

SCROLL COMPRESSOR WITH INCLINED SURFACES ON THE STEPPED PORTIONS

TECHNICAL FIELD

The present invention relates to a so-called stepped scroll compressor in which stepped portions are formed in spiral directions of a pair of scrolls (that is, a stationary scroll and a turning scroll) forming compression chambers.

BACKGROUND ART

A scroll compressor in which stepped portions are provided at arbitrary positions along spiral directions of top and bottom lands of spiral wraps of a stationary scroll and a turning scroll and the heights of the spiral wraps on an outer peripheral side are larger than the heights of the spiral wraps on an inner peripheral side with the stepped portions as boundaries is known in scroll compressors. This scroll compressor is adapted so that the heights of compression chambers in the direction of an axis on the outer peripheral side of spiral wraps are larger than the heights of the compression chambers in the direction of the axis on the inner peripheral side of the spiral wraps and three-dimensional compression can be performed, that is, gas is compressed in both circumferential directions and height directions of the spiral wraps. Accordingly, the performance of the scroll compressor is high and the size and weight of the scroll compressor are reduced.

In this stepped scroll compressor, high top lands, low top lands, high bottom lands, and low bottom lands with the stepped portions of both the scrolls as boundaries are generally formed of flat surfaces having the same height. However, PTL 1 provides a scroll compressor in which a gap, which is formed by the high bottom land and the low top land on the side closer to the inner periphery than the stepped portions, is set to be larger than a gap, which is formed by the low bottom land and the high top land on the side closer to the outer periphery than the stepped portions when both the scrolls mesh with each other so that both the gaps are substantially equal to each other by thermal expansion, in order to avoid the contact between the lands caused by thermal expansion.

CITATION LIST

Patent Literature

[PTL 1] Japanese Unexamined Patent Application Publication No. 2002-5052

SUMMARY OF INVENTION

Technical Problem

In the scroll compressor disclosed in PTL 1, since the temperature on the side closer to the inner periphery than the stepped portions is higher and the displacement in a height direction caused by thermal expansion is increased, the gap, which is formed by the high bottom land and the low top land on the side closer to the inner periphery than the stepped portions, is set to be large. However, in the stepped scroll compressor, unlike in a general scroll compressor, temperature in the compression chamber tends to suddenly rise in a turning angle range in which the stepped portions are included in the compression chamber, and the heights of the spiral wraps are large at the stepped portions. Accordingly, displacement in the height direction caused by thermal expansion is increased near the stepped portions.

For this reason, low bottom lands of the opposite scrolls corresponding to high top lands, which form stepped portions of the top and bottom lands of the spiral wraps near the stepped portions, or low top lands of the opposite scrolls corresponding to high bottom lands may come into contact with each other due to deformation caused by heat or deformation caused by pressure, the toppling of the turning scroll, or the like, and contact pressure may be abnormally increased at a contact portion therebetween. For this reason, there is a problem in that variation in performance is generated depending on operating conditions, the generation of abnormal noise or the deterioration of durability is caused, or the like.

The invention has been made in consideration of the above-mentioned circumstances, and an object of the invention is to provide a so-called stepped scroll compressor that can prevent variation of performance, the generation of abnormal noise, the reduction of yield strength, and the like by avoiding the abnormal increase of contact pressure caused by contact between a top land of a spiral wrap and a bottom land of an opposite scroll near a stepped portion.

Solution to Problem

In order to solve the above-mentioned problem, a scroll compressor of the invention employs the following means.

That is, in a scroll compressor according to the invention, stepped portions are provided at arbitrary positions along spiral directions of top and bottom lands of spiral wraps of a stationary scroll and a turning scroll and the heights of the spiral wraps on an outer peripheral side are larger than the heights of the spiral wraps on an inner peripheral side with the stepped portions as boundaries. Inclined surfaces of which the heights are gradually reduced toward the respective stepped portions are formed in a range of at least $2\rho$ to $3\rho$ (here, $\rho$ denotes a turning radius of the turning scroll) at (1) any one or both of inner peripheral end portions of the high top lands of the spiral wraps of both the scrolls and inner peripheral end portions of the low bottom lands of the spiral wraps of the opposite scrolls corresponding to the inner peripheral end portions and (2) any one or both of outer peripheral end portions of the high bottom lands of the spiral wraps of both the scrolls and outer peripheral end portions of the low top lands of the spiral wraps of the opposite scrolls corresponding to the outer peripheral end portions, on the stepped portions of the top and bottom lands of the spiral wraps of both the scrolls.

According to the invention, inclined surfaces of which the heights are gradually reduced toward the respective stepped portions are formed in a range of at least $2\rho$ to $3\rho$ (here, $\rho$ denotes a turning radius of the turning scroll) at (1) any one or both of inner peripheral end portions of the high top lands and inner peripheral end portions of the low bottom lands of the opposite scrolls corresponding to the inner peripheral end portions and (2) any one or both of outer peripheral end portions of the high bottom lands and outer peripheral end portions of the low top lands of the opposite scrolls corresponding to the outer peripheral end portions, on the stepped portions of the top and bottom lands of the spiral wraps of the stationary scroll and the turning scroll. For this reason, even though the end plates or the spiral wraps of a pair of scrolls (that is, the stationary and turning scrolls) are deformed by pressure or deformed by heat or the turning scroll topples during operation, it is possible to avoid the contact between the inner peripheral end portions of the high top lands where the stepped portions of the top and bottom lands of the spiral wraps of the stationary and turning scrolls are formed and the inner peripheral end portions of the low bottom lands of the opposite scrolls corresponding to the inner peripheral end portions or the contact between the outer peripheral end portions of the high bottom lands and the outer peripheral end portions of the low top lands of the opposite scrolls corresponding to the outer peripheral end portions and a situation such as the abnormal increase of contact pressure at the contact portions therebetween, by the respective inclined surfaces. Accordingly, it is possible to stabilize the performance of the scroll compressor, to reduce noise and vibration, and to improve yield strength by preventing the variation of performance or the generation of abnormal noise depending on operating conditions, the reduction of yield strength, and the like. Further, since the inclined surfaces are formed in the range of at least 2ρ to 3ρ of the turning radius ρ of the turning scroll, it is possible to reliably prevent the abnormal increase of contact pressure caused by the contact between the top and bottom lands in the entire range in which the stepped portions slide relative to each other.

Furthermore, in the scroll compressor of the invention, the inclined surfaces may be formed of inclined surfaces of which the heights are reduced from heights of the flat top or bottom lands by about several tens μm.

According to the above-mentioned structure, the inclined surfaces are formed of inclined surfaces of which the heights are reduced from the heights of the flat top or bottom lands by about several tens μm. For this reason, even though the inclined surfaces are formed, excessive gaps are not formed. Accordingly, while suppressing the leakage of gas from the inclined surfaces, it is possible to stabilize performance, to reduce noise and vibration, and to improve yield strength by reliably preventing the abnormal increase of contact pressure that is caused by the contact between the top and bottom lands near the stepped portions.

Moreover, in the scroll compressor according to the above-mentioned structure, the inclined surfaces may be formed of inclined surfaces of which the heights are reduced from the heights of the flat top or bottom lands by about 20 μm to 70 μm, and the inclined surfaces may be formed on both the top and bottom lands, respectively, when the inclined surfaces are formed so as to be distributed to both the top lands and the bottom lands of the spiral wraps of both the corresponding scrolls.

According to the invention, the inclined surfaces are formed of inclined surfaces of which the heights are reduced from the heights of the flat top or bottom lands by about 20 μm to 70 μm. When the inclined surfaces are formed on both the top lands and the bottom lands of the spiral wraps of both the corresponding scrolls, the inclined surfaces are formed so as to be distributed to both the top and bottom lands. For this reason, in a scroll compressor for an air conditioner that uses HFC refrigerant, it is possible to suppress the leakage of gas in the range where a problem does not occur while preventing abnormal contact between the top and bottom lands near the stepped portions, by setting height, which is to be reduced from the heights of the flat top and bottom lands that are the reference of the inclined surfaces, in the range of about 20 μm to 70 μm from the deformation amount including pressure, temperature, and the like, the degree of toppling of the turning scroll, or the like. Accordingly, it is possible to stabilize performance, to reduce noise and vibration, and to improve yield strength by preventing the variation of performance or the generation of abnormal noise depending on operating conditions, the reduction of yield strength, and the like.

In addition, in the scroll compressor of the invention, chamfers may be formed at contour portions of the stepped portions of the top and bottom lands.

According to the invention, chamfers are formed at contour portions of the stepped portions of the top lands and the bottom lands. For this reason, it is possible to prevent the generation of abnormal wear or abnormal noise, which is caused by the contact between edge portions of the respective stepped portions and the top or bottom lands of the spiral wraps of the opposite scrolls, by the chamfers, such as R-chamfers or C-chamfers, formed at the contour portions of the respective stepped portions. Accordingly, it is possible to further improve the reliability of the performance and the quality of the scroll compressor.

Advantageous Effects of Invention

According to the invention, even though the end plates or the spiral wraps of a pair of scrolls (that is, the stationary and turning scrolls) are deformed by pressure or deformed by heat or the turning scroll topples during operation, it is possible to avoid the contact between the inner peripheral end portions of the high top lands where the stepped portions of the top and bottom lands of the spiral wraps of the stationary and turning scrolls are formed and the inner peripheral end portions of the low bottom lands of the opposite scrolls corresponding to the inner peripheral end portions or the contact between the outer peripheral end portions of the high bottom lands and the outer peripheral end portions of the low top lands of the opposite scrolls corresponding to the outer peripheral end portions and a situation such as the abnormal increase of contact pressure at the contact portions therebetween, by the respective inclined surfaces. For this reason, it is possible to stabilize the performance of the scroll compressor, to reduce noise and vibration, and to improve yield strength by preventing the variation of performance or the generation of abnormal noise depending on operating conditions, the reduction of yield strength, and the like. Further, since the inclined surfaces are formed in the range of at least 2ρ to 3ρ of the turning radius ρ of the turning scroll, respectively, it is possible to reliably prevent the abnormal increase of contact pressure caused by the contact between the top and bottom lands in the entire range in which the stepped portions slide relative to each other.

DESCRIPTION OF EMBODIMENTS

An embodiment of the invention will be described below with reference to FIGS. 1 to 5.

Figure 1:
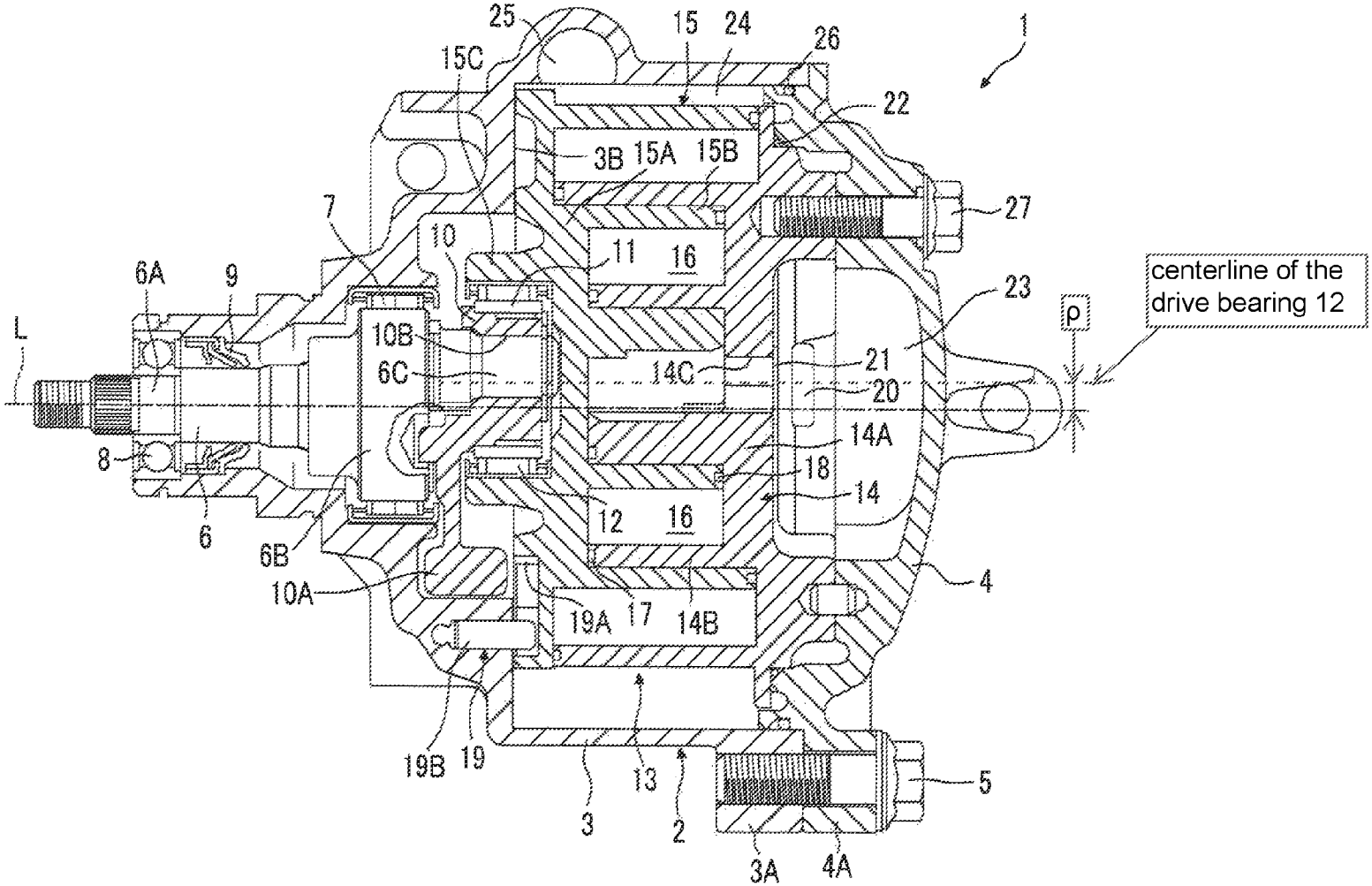
FIG. 1 is a longitudinal sectional view of a scroll compressor according to an embodiment of the invention.
Figure 2A:
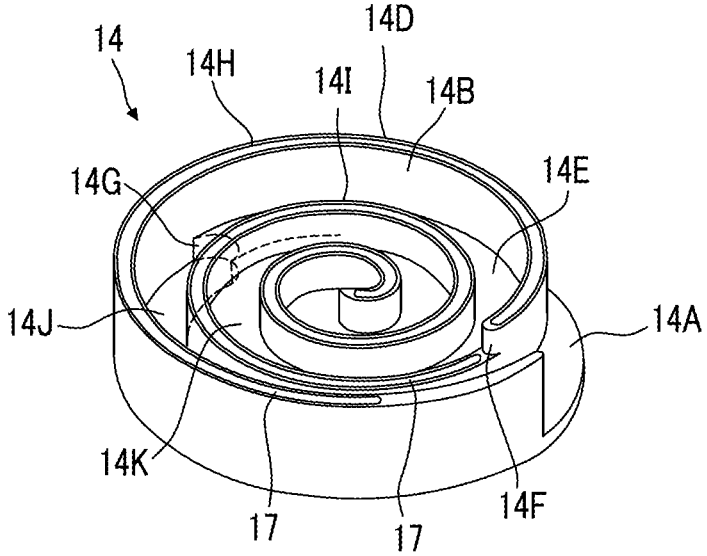
FIG. 2A is a perspective view of a stationary scroll and a turning scroll of the scroll compressor shown in FIG. 1.
Figure 2B:
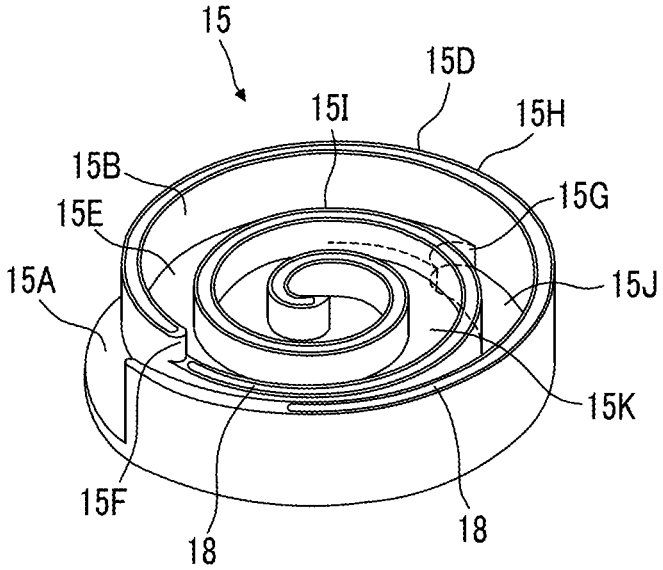
FIG. 2B is a perspective view of the stationary scroll and the turning scroll of the scroll compressor shown in FIG. 1.

FIG. 1 is a longitudinal sectional view of a scroll compressor according to an embodiment of the invention, and FIGS. 2A and 2B are perspective views of a stationary scroll and a turning scroll of the scroll compressor.

The scroll compressor 1 includes a housing 2 that forms an outer shell. A front housing 3 and a rear housing 4 are integrally fastened and fixed by bolts 5, so that the housing 2 is formed.

Fastening flanges 3A and 4A are integrally formed at regular intervals at a plurality of positions (for example, four positions) on the peripheral portions of the front and rear housings 3 and 4. The flanges 3A and 4A are fastened to each other by the bolts 5, so that the front and rear housings 3 and 4 are integrally joined to each other. A crankshaft (drive shaft) 6 is supported in the front housing 3 by a main bearing 7 and a sub-bearing 8 so as to be rotatable about an axis thereof.

One end portion (left end portion in FIG. 1) of the crankshaft 6 forms a small-diameter shaft portion 6A, and the small-diameter shaft portion 6A passes through the front housing 3 and protrudes to the left side in FIG. 1. An electromagnetic clutch, a pulley, and the like (not shown), which receive power as known, are provided at a protruding portion of the small-diameter shaft portion 6A, and power is transmitted to the protruding portion from a driving source such as an engine by a V-belt or the like. A mechanical seal (lip seal) 9 is installed between the main bearing 7 and the sub-bearing 8, and airtightly seals a gap between the housing 2 and the air.

A large-diameter shaft portion 6B is formed at the other end portion (right end portion in FIG. 1) of the crankshaft 6, and a crank pin 6C is integrally provided at the large-diameter shaft portion 6B so as to be eccentric from an axis L of the crankshaft 6 by a predetermined distance. Since the large-diameter shaft portion 6B and the small-diameter shaft portion 6A are supported in the front housing 3 by the main bearing 7 and the sub-bearing 8, the crankshaft 6 is rotatably supported. A turning scroll 15 to be described below is connected to the crank pin 6C through a drive bush 10, a cylindrical ring (floating bush) 11, and a drive bearing 12. Accordingly, when the crankshaft 6 is rotated, the turning scroll 15 is driven to be turned.

The drive bush 10 is integrally provided with a balance weight 10A that removes an unbalanced load generated by the turning drive of the turning scroll 15, and the balance weight 10A is turned with the turning drive of the turning scroll 15. Further, a crank pin hole 10B to which the crank pin 6C is fitted is formed in the drive bush 10 at a position that is eccentric from the center of the drive bush 10. Accordingly, a known driven crank mechanism in which the drive bush 10 and the turning scroll 15 fitted to the crank pin 6C receive a reaction against the compression of gas and are revolved around the crank pin 6C so that the turning radius of the turning scroll 15 is variable is formed.

A scroll compaction mechanism 13, which includes a pair of scrolls (that is, a stationary scroll 14 and the turning scroll 15), is assembled in the housing 2. The stationary scroll 14 includes a stationary end plate 14A and a stationary spiral wrap 14B that is erected on the stationary end plate 14A. The turning scroll 15 includes a turning end plate 15A and a turning spiral wrap 15B that is erected on the end plate 15A.

As shown in FIGS. 2A and 2B, stepped portions 14F, 15F and 14G, 15G are formed on the stationary and turning scrolls 14 and 15 at predetermined positions along the spiral directions of top lands 14D and 15D and bottom lands 14E and 15E of the respective spiral wraps 14B and 15B. With the stepped portions 14F, 15F and 14G, 15G as boundaries, on the sides close to the top lands 14D and 15D, top lands 14H and 15H provided on the outer peripheral side are high (referred to as high top lands 14H and 15H) in the direction of the axis L and top lands 14I and 15I provided on the inner peripheral side are low (referred to as low top lands 14I and 15I). The respective top lands are formed of flat surfaces having the same height.

Meanwhile, on the sides close to the bottom lands 14E and 15E, bottom lands 14J and 15J, which are positioned on the outer peripheral side, are low (referred to as low bottom lands 14J and 15J) in the direction of the axis L and bottom lands 14K and 15K, which are positioned on the inner peripheral side, are high (referred to as high bottom lands 14K and 15K). The respective bottom lands are formed of flat surfaces having the same height. Accordingly, the height of each of the spiral wraps 14B and 15B on the outer peripheral side is larger than the height thereof on the inner peripheral side.

The stationary and turning scrolls 14 and 15 mesh with each other so that the centers of the stationary and turning scrolls 14 and 15 are separated from each other by a turning radius ρ and phases of the respective spiral wraps 14B and 15B are shifted by 180°, and are fitted to each other so that slight clearances in the height direction of the wrap are formed between the top lands 14D and 15D and the bottom lands 14E and 15E of the opposite scrolls at room temperature. Accordingly, as shown in FIG. 1, a plurality of pairs of compression chambers 16, which are defined by the respective end plates 14A and 15A and the respective spiral wraps 14B and 15B, are formed between both the scrolls 14 and 15 so as to be point-symmetrical with respect to the centers of the scrolls, and the turning scroll 15 can smoothly turn about the stationary scroll 14.

The heights of the compression chambers 16 in the direction of the axis L on the outer peripheral side of each of the spiral wraps 14B and 15B are larger than the heights of the compression chambers 16 in the direction of the axis L on the inner peripheral side of each of the spiral wraps 14B and 15B. Accordingly, the scroll compaction mechanism 13, which can perform three-dimensional compression, that is, can compress gas in both the circumferential direction and the height direction of each of the spiral wraps 14B and 15B, is formed. Tip seals 17 and 18, which seal tip seal surfaces formed between the bottom lands 14E and 15E of the opposite scrolls, are installed at the top lands 14D and 15D of the spiral wraps 14B and 15B of the respective stationary and turning scrolls 14 and 15 by being fitted to grooves that are formed at the respective top lands 14D and 15D.

The stationary scroll 14 is fixed to and installed on the inner surface of the rear housing 4 by bolts 27. Further, the crank pin 60 provided at one end portion of the crankshaft 6 is connected to a boss portion 150, which is formed on the back of the turning end plate 15A, through the drive bush 10, the cylindrical ring (floating bush) 11, and the drive bearing 12 as described above so that the turning scroll 15 is driven to be turned.

In addition, the turning scroll 15 is adapted so that the back of the turning end plate 15A is supported by a thrust receiving surface 3B of the front housing 3 and the turning scroll 15 is driven to revolve about the stationary scroll 14 while the rotation of the turning scroll 15 is prevented by a rotation preventing mechanism 19 provided between the thrust receiving surface 3B and the back of the turning end plate 15A. The rotation preventing mechanism 19 of this embodiment is formed of a pin-ring type rotation preventing mechanism 19 in which a rotation preventing pin 19B fitted to a pin hole of the front housing 3 is slidably fitted to the inner peripheral surface of a rotation preventing ring 19A fitted to a ring hole formed at the turning end plate 15A of the turning scroll 15.

A discharge port 14C, through which compressed refrigerant gas is discharged, is opened at the central portion of the stationary end plate 14A of the stationary scroll 14, and a discharge valve 21, which is mounted on the stationary end plate 14A through a retainer 20, is installed at the discharge port 14C. Further, a seal member 22 such as an O-ring is provided on the back side of the stationary end plate 14A so as to come into close contact with the inner surface of the rear housing 4, and a discharge chamber 23, which is partitioned from the internal space of the housing 2, is formed between the inner surface of the rear housing 4 and the back side of the stationary end plate 14A. Accordingly, the internal space of the housing 2 except for the discharge chamber 23 functions as a suction chamber 24.

Refrigerant gas, which returns from a refrigeration cycle through a suction port 25 formed at the front housing 3, is sucked into the suction chamber 24 and the refrigerant gas is sucked into the compression chambers 16 through the suction chamber 24. A seal member 26 such as an O-ring is provided on a joint surface between the front and rear housings 3 and 4, and airtightly seals the suction chamber 24, which is formed in the housing 2, from the air.

Figure 3A:
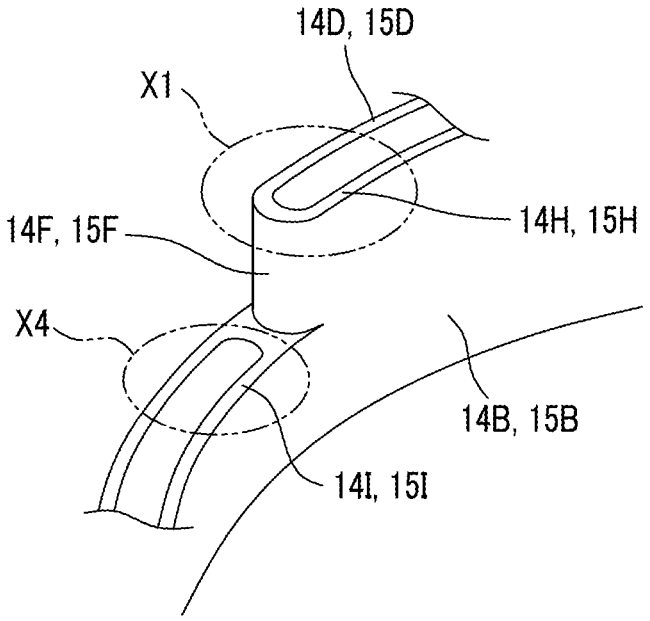
FIG. 3A is an enlarged perspective view of the vicinity of stepped portions of top lands and bottom lands of the stationary scroll and the turning scroll shown in FIG. 2.
Figure 3B:
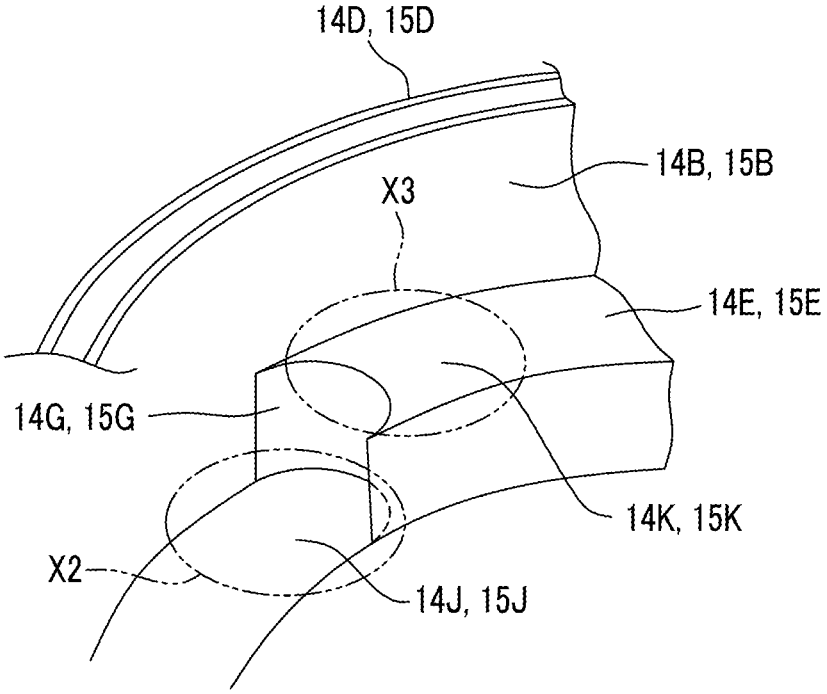
FIG. 3B is an enlarged perspective view of the vicinity of the stepped portions of the top lands and the bottom lands of the stationary scroll and the turning scroll shown in FIG. 2.

FIGS. 3A and 3B are enlarged perspective views of the vicinity of the stepped portions 14F, 15F and 14G, 15G that are formed at the top lands 14D and 15D and the bottom lands 14E and 15E of the spiral wraps 14B and 15B of the stationary and turning scrolls 14 and 15 of the above-mentioned scroll compressor 1.

Figure 4:
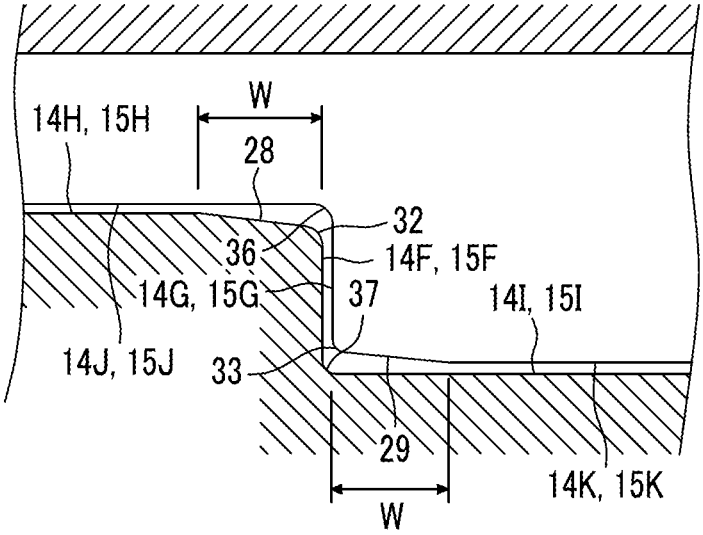
FIG. 4 is a development view of a state in which the stationary scroll and the turning scroll shown in FIG. 2 mesh with each other, taken along a longitudinal direction of a compression chamber.
Figure 5:
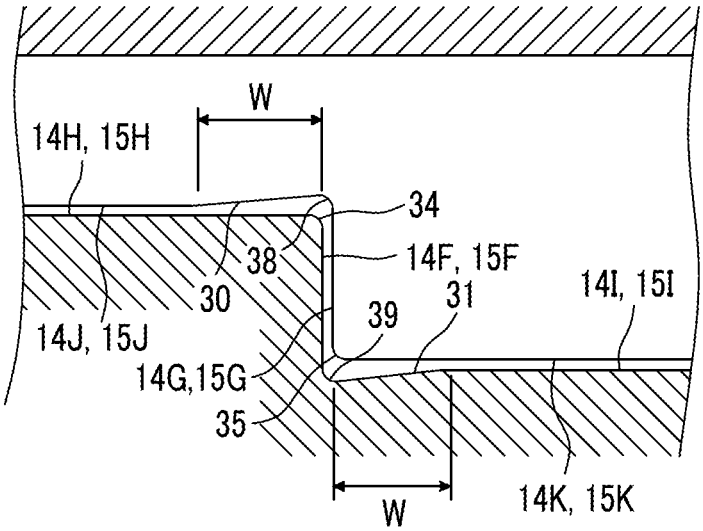
FIG. 5 is a development view of another example of a state in which the stationary scroll and the turning scroll shown in FIG. 2 mesh with each other, taken along the longitudinal direction of the compression chamber.

As shown in FIGS. 4 and 5, inclined surfaces 28, 29, 30, and 31 of which the heights are gradually reduced toward the stepped portions 14F, 15F and 14G, 15G are formed near the stepped portions 14F, 15F and 14G, 15G in the range W of at least 2ρ to 3ρ (here, ρ denotes the turning radius of the turning scroll 15) at (1) any one or both of inner peripheral end portions X1 of the high top lands 14H and 15H of the spiral wraps 14B and 15B of both the scrolls 14 and 15 and inner peripheral end portions X2 of the low bottom lands 14J and 15J of the opposite scrolls 14 and 15 corresponding to the inner peripheral end portions X1 and (2) any one or both of outer peripheral end portions X3 of the high bottom lands 14K and 15K of the spiral wraps 14B and 15B of both the scrolls 14 and 15 and outer peripheral end portions X4 of the low top lands 14I and 15I of the opposite scrolls 14 and 15 corresponding to the outer peripheral end portions X3.

That is, an embodiment shown in FIG. 4 describes an example in which the inclined surfaces 28 and 29 of which the heights are gradually reduced toward the stepped portions 14F, 15F and 14G, 15G are formed in the range W of at least 2ρ to 3ρ at (1) the inner peripheral end portions X1 of the high top lands 14H and 15H of the spiral wraps 14B and 15B of both the scrolls 14 and 15, and (2) the outer peripheral end portions X3 of the high bottom lands 14K and 15K of the spiral wraps 14B and 15B of both the scrolls 14 and 15.

Further, an embodiment shown in FIG. 5 describes an example in which the inclined surfaces 30 and 31 of which the heights are gradually reduced toward the stepped portions 14F, 15F and 14G, 15G are formed in the range W of at least 2ρ to 3ρ at (1) the inner peripheral end portions X2 of the low bottom lands 14J and 15J of the spiral wraps 14B and 15B of both the scrolls 14 and 15, and (2) the outer peripheral end portions X4 of the low top lands 14I and 15I of the spiral wraps 14B and 15B of both the scrolls 14 and 15.

Meanwhile, FIG. 4 shows the embodiment in which the inclined surfaces 28 and 29 are formed only at one of the inner peripheral end portions X1 of the top lands 14H and 15H and the outer peripheral end portions X3 of the bottom lands 14K and 15K, and FIG. 5 shows the embodiment in which the inclined surfaces 30 and 31 are formed only at one of the inner peripheral end portions X2 of the bottom lands 14J and 15J and the outer peripheral end portions X4 of the top lands 14I and 15I. However, these inclined surfaces 28, 29, 30, and 31 may be formed on both the top and bottom lands on halves.

Further, the inclined surfaces 28 and 29 or 30 and 31 are formed of inclined surfaces of which the heights are gradually smoothly reduced from the heights of the flat top lands 14H, 14I, 15H, and 15I or bottom lands 14J, 14K, 15J, and 15K as the reference by about several tens μm, more specifically, about 20 μm to 70 μm. However, the inclined surfaces 28 and 29 or 30 and 31 shown in FIGS. 4 and 5 are shown to be extremely deformed.

Furthermore, as shown in FIGS. 4 and 5, chamfers 32, 33, 34, and 35, such as R-chamfers or C-chamfers, are formed at contour portions of the stepped portions 14F, 15F and 14G, 15G that are formed at the top lands 14D and 15D and the bottom lands 14E and 15E, and the same chamfers 36, 37, 38, and 39 as the chamfers are also formed at base portions of the stepped portions 14F, 15F and 14G, 15G so as to correspond to the chamfers.

According to this embodiment, the following effects are obtained from the structure described above.

When power is transmitted to the crankshaft 6 from an external driving source through the pulley, the electromagnetic clutch, and the like and the crankshaft 6 is rotated, the turning scroll 15, which is connected to the crank pin 6C of the crankshaft 6 through the drive bush 10, the cylindrical ring (floating bush) 11, and the drive bearing 12 so that a turning radius is variable, is driven to revolve about the stationary scroll 14 with a predetermined turning radius ρ while the rotation of the turning scroll 14 is prevented by the pin-ring type rotation preventing mechanism 19.

Refrigerant gas, which is present in the suction chamber 24, is taken into the pair of compression chambers 16, which are formed on the outermost periphery in a radial direction, by the revolving drive of the turning scroll 15. After the suction of refrigerant gas is stopped at a predetermined turning angle position of the compression chamber 16, the refrigerant gas is moved to the central side while the volume of the refrigerant gas is reduced in the circumferential direction and the height direction of the wrap. The refrigerant gas is compressed in this period. When the refrigerant gas reaches a position where the compression chamber 16 communicates with the discharge port 14C, the discharge valve 21 is pushed and opened. As a result, the compressed gas having high temperature and high pressure is discharged into the discharge chamber 23, and is sent to the outside of the scroll compressor 1 through the discharge chamber 23.

During this compression operation, there is a concern that the stationary and turning scrolls 14 and 15 are affected by deformation caused by heat or pressure that is generated by the compression operation or a slight tilting operation that occurs during the revolution of the turning scroll 15, particularly, the top lands 14D and 15D and the bottom lands 14E and 15E come into contact with each other at the stepped portions 14F, 15F and 14G, 15G of the stationary and turning scrolls 14 and 15.

However, this embodiment employs a structure in which the inclined surfaces 28, 29, 30, and 31 of which the heights are gradually reduced toward the respective stepped portions 14F, 15F and 14G, 15G are formed in the range W of at least 2ρ to 3ρ (here, ρ denotes the turning radius of the turning scroll) at (1) any one or both of the inner peripheral end portions X1 of the high top lands 14H and 15H and the inner peripheral end portions X2 of the low bottom lands 14J and 15J of the opposite scrolls 14 and 15 corresponding to the inner peripheral end portions X1 and (2) any one or both of the outer peripheral end portions X3 of the high bottom lands 14K and 15K and the outer peripheral end portions X4 of the low top lands 14I and 15I of the opposite scrolls 14 and 15 corresponding to the outer peripheral end portions X3, on the stepped portions 14F, 15F and 14G, 15G of the top lands 14D and 15D and the bottom lands 14E and 15E of the spiral wraps 14B and 15B of the stationary and turning scrolls 14 and 15.

For this reason, even though the end plates 14A and 15A or the spiral wraps 14B and 15B of the stationary and turning scrolls 14 and 15 are deformed by pressure or deformed by heat or the turning scroll 15 topples during operation, it is possible to avoid the contact between the inner peripheral end portions X1 of the high top lands 14H and 15H where the stepped portions 14F, 15F and 14G, 15G of the top lands 14D and 15D and the bottom lands 14E and 15E of the spiral wraps 14B and 15B of the stationary and turning scrolls 14 and 15 are formed and the inner peripheral end portions X2 of the low bottom lands 14J and 15J of the opposite scrolls 14 and 15 corresponding to the inner peripheral end portions X1 or the contact between the outer peripheral end portions X3 of the high bottom lands 14K and 15K and the outer peripheral end portions X4 of the low top lands 14I and 15I of the opposite scrolls 14 and 15 corresponding to the outer peripheral end portions X3 and a situation such as the abnormal increase of contact pressure at the contact portions therebetween, by the respective inclined surfaces 28 and 29 or 30 and 31.

Accordingly, it is possible to stabilize the performance of the scroll compressor 1, to reduce noise and vibration, and to improve yield strength by preventing the variation of performance or the generation of abnormal noise depending on operating conditions, the reduction of yield strength, and the like. In addition, since the inclined surfaces 28, 29, 30, and 31 are formed in the range W of at least 2ρ to 3ρ of the turning radius ρ of the turning scroll 15, it is possible to reliably prevent the abnormal increase of contact pressure caused by the contact between the top lands 14H, 15H and 14I, 15I and the bottom lands 14J, 15J and 14K, 15K in the entire range in which the stepped portions 14F, 15F and 14G, 15G slide relative to each other.

Further, the inclined surfaces 28, 29, 30, and 31 are formed of inclined surfaces of which the heights are reduced from the heights of the flat top lands 14D and 15D and the bottom lands 14E and 15E by about several tens μm. For this reason, even though the inclined surfaces 28 and 29 or 30 and 31 are formed, particularly excessive gaps are not formed by the inclined surfaces. Accordingly, while suppressing the leakage of gas from the inclined surfaces 28, 29, 30, and 31, it is possible to stabilize performance, to reduce noise and vibration, and to improve yield strength by reliably preventing the abnormal increase of contact pressure that is caused by the contact between the top lands 14H, 15H and 14I, 15I and the bottom lands 14J, 15J and 14K, 15K near the stepped portions 14F, 15F and 14G, 15G.

Furthermore, in this embodiment, the inclined surfaces 28, 29, 30, and 31 are formed of inclined surfaces of which the heights are reduced from the heights of the flat top lands 14D and 15D and bottom lands 14E and 15E by about 20 μm to 70 μm. When the inclined surfaces 28, 29, 30, and 31 are formed on both the top lands 14H, 14I and 15H, 15I and the bottom lands 14J, 14K and 15J, 15K of the spiral wraps 14B and 15B of both the corresponding scrolls 14 and 15, the inclined surfaces 28, 29, 30, and 31 may be formed so as to be distributed to both the top and bottom lands.

For this reason, in a scroll compressor 1 for an air conditioner that uses HFC refrigerant, it is possible to suppress the leakage of gas in the range where a problem does not occur while preventing abnormal contact between the top lands 14H, 15H and 14I, 15I and the bottom lands 14J, 15J and 14K, 15K near the stepped portions 14F, 15F and 14G, 15G, by setting height, which is to be reduced from the heights of the flat top lands 14D and 15D or the bottom lands 14E and 15E that are the reference of the inclined surfaces 28, 29, 30, and 31, in the range of about 20 μm to 70 μm from the deformation amount including pressure, temperature, and the like, the degree of toppling of the turning scroll 15, or the like. Accordingly, it is possible to stabilize performance, to reduce noise and vibration, and to improve yield strength by preventing the variation of performance or the generation of abnormal noise depending on operating conditions, the reduction of yield strength, and the like.

Further, since the chamfers 32, 33, 34, and 35, such as R-chamfers or C-chamfers, are formed at contour portions of the stepped portions 14F, 15F and 14G, 15G of the top lands 14D and 15D or the bottom lands 14E and 15E, it is possible to prevent the generation of abnormal wear or abnormal noise, which is caused by the contact between edge portions of the respective stepped portions 14F, 15F and 14G, 15G and the top lands 14H, 15H and 14I, 15I and the bottom lands 14J, 15J and 14K, 15K of the spiral wraps 14B and 15B of the opposite scrolls 14 and 15, by these chamfers 32, 33, 34, and 35. Accordingly, it is possible to further improve the reliability of the performance and quality of the scroll compressor 1.

Furthermore, since the same chamfers 36, 37, 38, and 39 as the chamfers are also formed at the base portions of the stepped portions 14F, 15F and 14G, 15G so as to correspond to the chamfers 32, 33, 34, and 35, it is also possible to expect the improvement of the yield strength of the spiral wraps 14B and 15B by preventing the widening of the gap at the respective stepped portions 14F, 15F and 14G, 15G and reducing stress concentration on corners.

Meanwhile, the invention is not limited to an invention according to the embodiment, and may be appropriately modified without departing from the gist of the invention. For example, an example in which the invention is applied to an open type scroll compressor 1 driven by power supplied from the outside has been described in the above-mentioned embodiment. However, it goes without saying that the invention can also be applied to a closed type scroll compressor in which an electric motor as a power source is built. Further, the pin-ring type rotation preventing mechanism has been described as the rotation preventing mechanism 19 of the turning scroll 15, but other rotation preventing mechanisms such as an oldham-ring type rotation preventing mechanism may be used. Furthermore, the driven crank mechanism is not also limited to an oscillation-type driven crank mechanism used in the above-mentioned embodiment, and other types of driven crank mechanisms may be used.

REFERENCE SIGNS LIST

1: scroll compressor
14: stationary scroll
14B: stationary spiral wrap
14D: top land
14E: bottom land
14F, 14G: stepped portion
14H: high top land
14I: low top land
14J: low bottom land
14K: high bottom land
15: turning scroll
15B: turning spiral wrap
15D: top land
15E: bottom land
15F, 15G: stepped portion
15H: high top land
15I: low top land
15J: low bottom land
15K: high bottom land
28, 29, 30, 31: inclined surface
32, 33, 34, 35: chamfer
W: range of 2ρ to 3ρ
X1: inner peripheral end portion of high top land
X2: inner peripheral end portion of low bottom land
X3: outer peripheral end portion of high bottom land
X4: outer peripheral end portion of low top land

The invention claimed is:

1. A scroll compressor comprising:

stepped portions provided at arbitrary positions along spiral directions of top and bottom lands of spiral wraps of a stationary scroll and a turning scroll;

the heights of the spiral wraps on an outer peripheral side are larger than the heights of the spiral wraps on an inner peripheral side with the stepped portions as boundaries, wherein inclined surfaces of which the heights are gradually reduced toward the respective stepped portions are formed in a range of 2ρ to 3ρ, in which ρ denotes a turning radius of the turning scroll, at:

(1) any one or both of inner peripheral end portions of the high top lands of the spiral wraps of both the scrolls and inner peripheral end portions of the low bottom lands of the spiral wraps of the opposite scrolls corresponding to the inner peripheral end portions, and (2) any one or both of outer peripheral end portions of the high bottom lands of the spiral wraps of both the scrolls and outer peripheral end portions of the low top lands of the spiral wraps of the opposite scrolls corresponding to the outer peripheral end portions, on the stepped portions of the top and bottom lands of the spiral wraps of both the scrolls.

2. The scroll compressor according to claim 1, wherein the inclined surfaces are formed of inclined surfaces of which the heights are reduced from heights of the flat top or bottom lands by several tens μm.

3. The scroll compressor according to claim 2, wherein chamfers are formed at contour portions of the stepped portions of the top and bottom lands.

4. The scroll compressor according to claim 1, wherein the inclined surfaces are formed of inclined surfaces of which the heights are reduced from the heights of the flat top or bottom lands by 20 μm to 70 μm, and the inclined surfaces are formed so as to be distributed to both the top and bottom lands when the inclined surfaces are formed on both the top lands and the bottom lands of the spiral wraps of both the corresponding scrolls.

5. The scroll compressor according to claim 4, wherein chamfers are formed at contour portions of the stepped portions of the top and bottom lands.

6. The scroll compressor according to claim 1, wherein chamfers are formed at contour portions of the stepped portions of the top and bottom lands.

7. The scroll compressor according to claim 1, wherein a tip seal is installed at the top land of the spiral wrap of the respective stationary and turning scrolls by being fitted to a groove that is formed at the respective top lands.

* * * * *